US005289200A

United States Patent [19]

Kelly

[11] Patent Number: 5,289,200

[45] Date of Patent: Feb. 22, 1994

[54] TAB COUPLED SLOTS FOR WAVEGUIDE FED SLOT ARRAY ANTENNAS

[75] Inventor: Kenneth C. Kelly, Sherman Oaks, Calif.

[73] Assignee: Hughes Aircraft Company, Los Angeles, Calif.

[21] Appl. No.: 951,990

[22] Filed: Sep. 28, 1992

[51] Int. Cl.[5] ..... H01Q 13/10

[52] U.S. Cl. ..... 343/771; 343/767

[58] Field of Search ..... 343/767, 770, 771; 333/21 A, 21 R; H01Q 13/10

[56] References Cited

U.S. PATENT DOCUMENTS

| | | | |
|---|---|---|---|
| 4,788,552 | 11/1988 | Karlsson | 343/767 |
| 4,839,662 | 6/1989 | Wood | 343/771 |
| 4,878,060 | 10/1989 | Barbier et al. | 343/778 |

*Primary Examiner*—Michael C. Wimer

*Assistant Examiner*—Tan Ho

*Attorney, Agent, or Firm*—L. A. Alkov; W. K. Denson-Low

[57] ABSTRACT

A shunt coupled array of slots in a waveguide broadwall, wherein the slots are defined by a punch operation which leaves a tab connected at one side of the slot. The slot side to which the tabs are connected is alternated. The tabs extend downwardly into the waveguide and provide a means for exciting the slots without requiring the longitudinal slots to be alternatively offset. Thus, the invention provides a method of fabrication which permits elimination of the slot offsets, while at the same time is lower in cost than conventional methods of creating slot openings arrays. Higher antenna gain results from a given aperture when slot offsets are eliminated and the slots are truly located along straight lines in rows and columns.

19 Claims, 4 Drawing Sheets

TAB COUPLED SLOTS FOR WAVEGUIDE FED SLOT ARRAY ANTENNAS

BACKGROUND OF THE INVENTION

The present invention relates to fabrication cost and performance improvements in waveguide-fed slot array antennas.

Waveguide-fed slot array antennas are well known in the art. One type of this slot array antenna uses shunt coupled broad wall radiating slots.

An array of slot radiators disposed in a straight line along a wall of a waveguide is employed frequently to generate a beam of electromagnetic power. As a typical example of an array antenna composed of slot radiators, the antenna comprises a waveguide of rectangular cross section wherein the width of a broad wall is approximately double the height of a narrow wall, and wherein the slots are formed within one of the broad walls. Antennas are constructed also of a plurality of these slotted waveguides arranged side-by-side to provide a two-dimensional array of slot radiators arranged in rows and columns. To facilitate description of the antenna, a column of slot radiators is considered to be oriented in the longitudinal direction to a waveguide, in the direction of propagation of electromagnetic power, and a row of slot radiators is considered to be transverse to the waveguide. An antenna composed of a single waveguide generates a fan beam while an antenna composed of a plurality of the waveguides arranged side by side produces a beam having well-defined directivity on two dimensions.

Antennas employing slot radiators may have slots which are angled relative to a center line of the broad wall of the waveguide, or may have slots which are arranged parallel to the center line of the broad wall of the waveguide. In order to attain a desired linear polarization, and a desired illumination function of the radiating aperture of the entire antenna, the configuration of the antenna of primary interest herein is to be configured with all of the slots being parallel to each other.

A co-phasal relationship among the radiations from the various slot radiators is employed for generating a broadside beam directed perpendicularly to a plane containing the plurality of slot radiators. Herein, the antenna comprising the two-dimensional array of rows and columns of radiators with slots oriented in the column direction is of primary interest. One method of obtaining the co-phasal relationship is to position the slot radiators in alternating offsets fashioned along a centerline of each waveguide broad wall. The transverse offsetting of the slot radiator permits a coupling with a non-zero value of longitudinal component of the magnetic field of the electromagnetic wave in each of the waveguides. With a spacing of one-half guide wavelength along the direction of propagation within the waveguide, the alternation of the offsetting compensates for periodic variations in the phase of the magnetic field so as to obtain a constant value of phase in the radiated field. The waveguides are fed in phase and operate in the $TE_{10}$ mode. Since the spacing and pattern of alternation of offsetting of slot radiators is the same in each of the waveguides, good control of the radiated beam is obtained without excessive grating lobes, i.e., energy radiating in unintended directions.

However, in the event that a $TE_{n,0}$ mode rectangular waveguide, having a single broad wall with n columns and many rows of slots is employed in the lieu of the plurality of parallel slotted waveguides, then the relationship among the wave components in each of the columns changes. The phasing of the components of the wave in one column is 180 degrees out of phase with the wave components of the contiguous column. To compensate for this phasing of the wave components within the waveguide, the pattern of offset slot radiators of one column must be reversed from that of the contiguous columns of slots to ensure identity of slot phasing.

A problem arises in that the foregoing arrangement of reversed patterns of offset slot radiators introduces excessive grating lobes in addition to the desired beam. The resulting loss of antenna gain militates against the convenience of using a very wide waveguide with a single broad wall as an antenna, unless the grating lobes can be eliminated. This invention relates to a method to eliminate slot offsets while also reducing cost of fabrication.

The issue of eliminating slot offsets while maintaining producibility is the subject of U.S. Pat. Nos. 5,010,351 and 4,985,708 by the inventor of the present invention. The invention of U.S. Pat. No. 5,010,351 requires that an extra element in the form of an iris or vane be placed in the waveguide for each radiating slot employed. The invention of U.S. Pat. No. 4,985,708 requires that a thick and heavy plate be used for the wall of the waveguide to be slotted, and that slots be cut at an angle through that thick plate.

SUMMARY OF THE INVENTION

A waveguide fed slot radiator antenna employing tab coupled slots in accordance with this invention includes a rectangular waveguide having a height less than one-half wavelength and a broadwall several wavelengths wide. A plurality of slots are defined along rows and columns in the broadwall. The slots are preferably spaced by a distance of one half the waveguide wavelength in the propagation direction, and are formed by punching out waveguide broadwall material so that material removed or displaced from the plane of the broadwall is bent into the waveguide interior to define a tab attached to the broadwall at only one side of each slot. The side to which respective tabs of adjacent slots is attached alternates, so that the tabs are bent into the waveguide along respective left and right sides of adjacent slots, and extend substantially parallel to the waveguide propagation direction in planes perpendicular to the broadwall. With this arrangement all slots radiate in phase with each other to produce a desired broadside beam. Slots may also be created with tabs attached to just the left sides or just the right sides to produce a beam at approximately 45° off broadside. With appropriate machine tools, all slots and tabs can be formed simultaneously and thus reduce costs.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
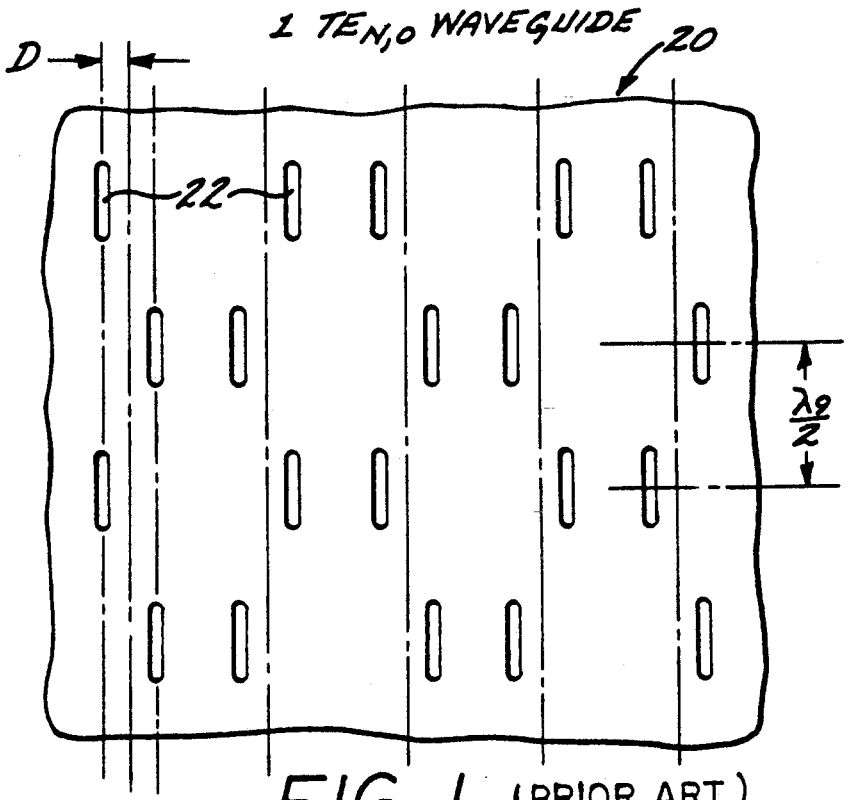
FIG. 1 (PRIOR ART)
FIGS. 1 and 2 illustrate planar array antennas employing offset radiating slots fabricated by conventional techniques, and fed by two forms of rectangular waveguides.
Figure 2:
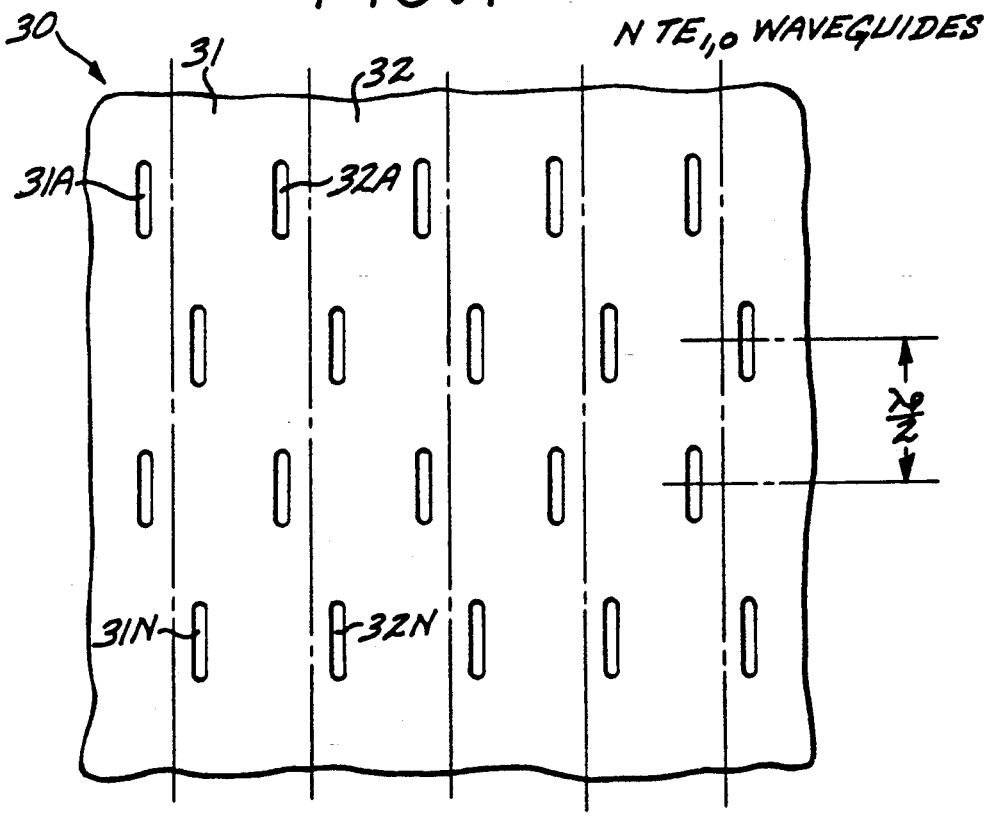
FIG. 2 (PRIOR ART)

A conventional method of making slotted rectangular waveguide planar array antennas results in slot positions as illustrated in FIG. 1 and FIG. 2. FIG. 1 shows one $TE_{N,0}$ waveguide 20, comprising a plurality of offset radiating slots 22 formed in a broadwall, wherein the slots are spaced longitudinally by $\lambda_g/2$, i.e., one-half the waveguide wavelength. FIG. 2 illustrates an array 30 comprising a quantity of N $TE_{1,0}$ waveguides 31, 32 . . . , wherein a plurality of spaced slots 31A-N, 32A-N, . . . , are formed in respective broadwalls. As in the array 20 of FIG. 1 the slots are separated longitudinally by a distance $\lambda_g/2$.

Figure 3:
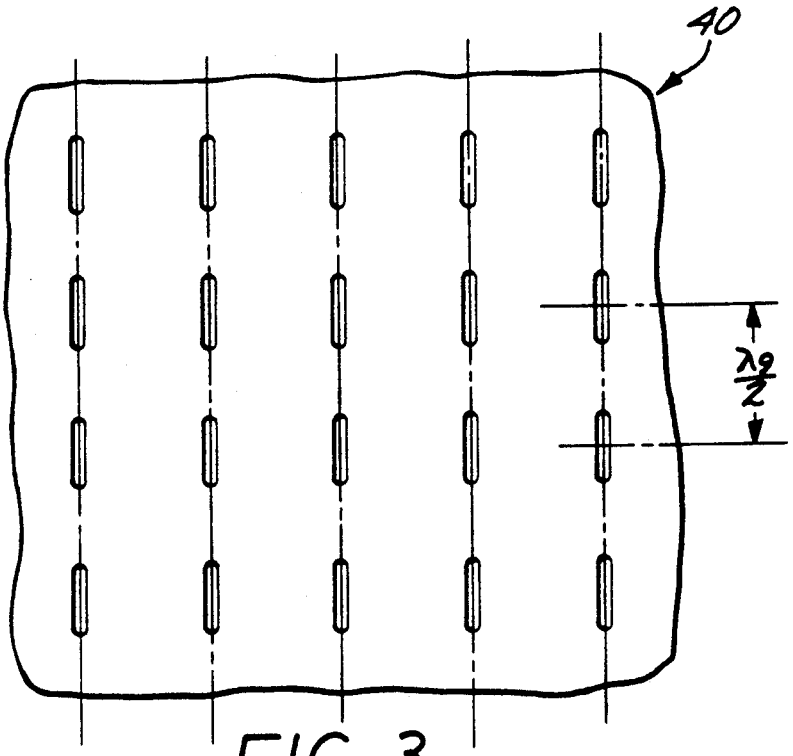
FIG. 3 illustrates a planar array antenna employing aligned slot radiators fed by rectangular waveguide operating in the $TE_{6,0}$ mode for this example.

The reason for the stagger or offsets of the slots in arrays 20 and 30 is to achieve coupling to the energy in the waveguides. (The offset distance D is shown in FIG. 1.) The highest antenna gain is achieved when there is no offset and the array face 40 is as shown in FIG. 3, the result with this invention.

Further, major cost reductions are realized when slots can be punched, rather than being machined using mechanical cutters or electrostatic discharge machining (EDM). The present invention uses punching to form the slots and saves the metal displaced so that the displaced metal becomes a "tab" which produces broadband coupling between the energy in the waveguide and the exterior.

Figure 4:
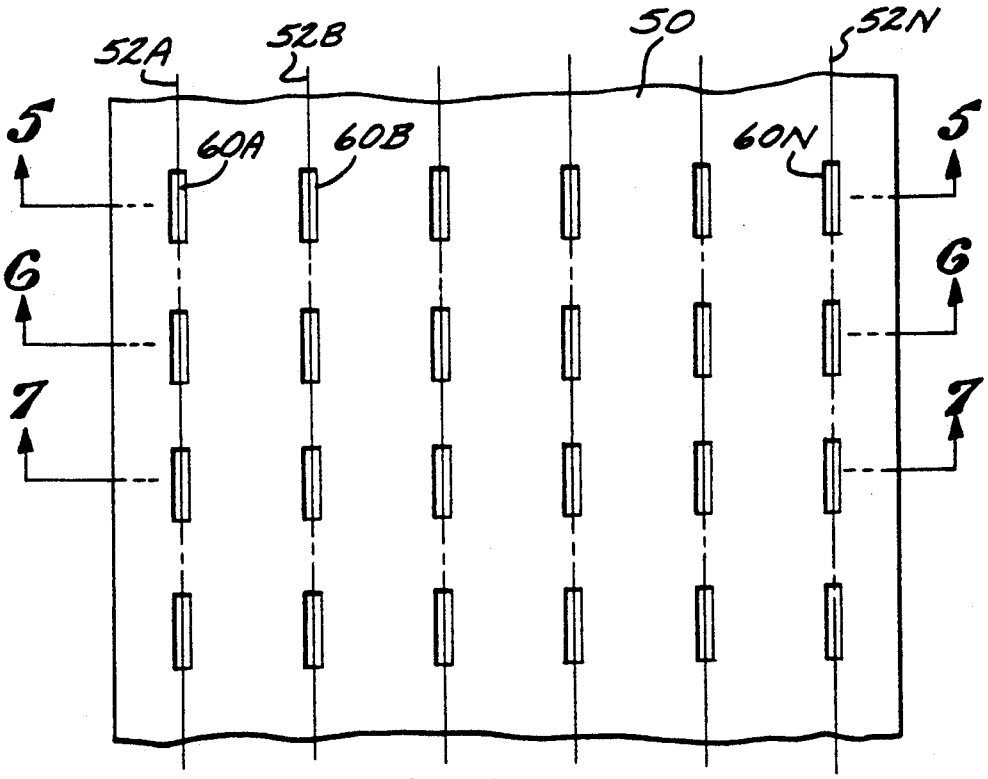
FIGS. 4≧7 illustrate a method in accordance with this invention of fabricating a planar array waveguide antenna with aligned radiating slots.
Figure 5:
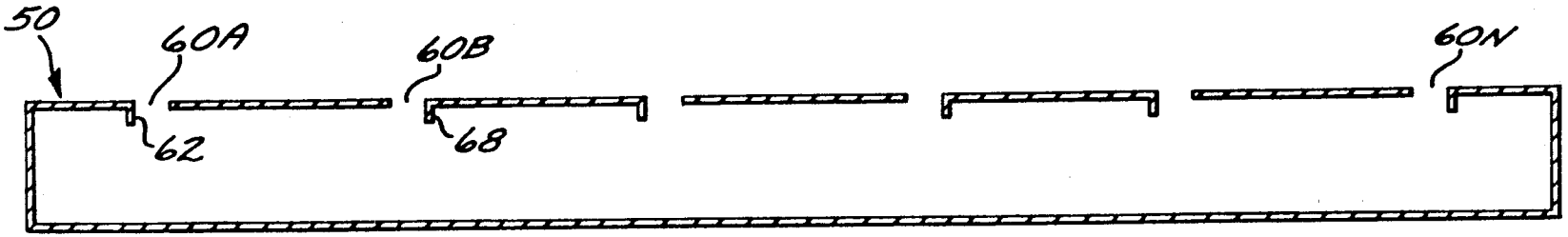
Figure 6:
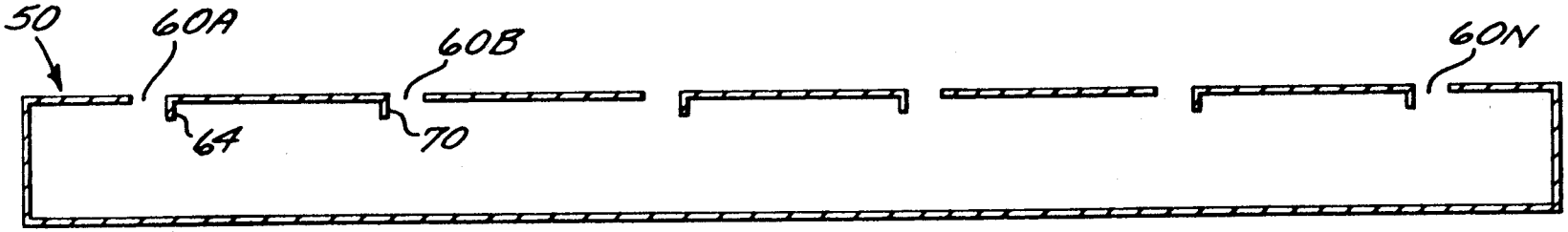
Figure 7:
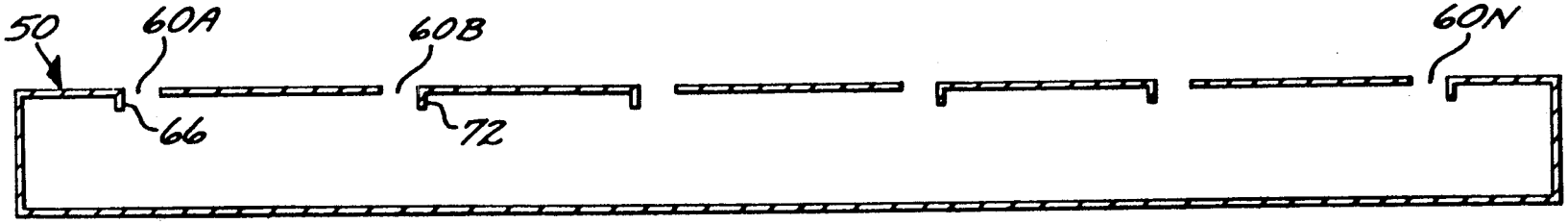

FIGS. 4-7 illustrate the invention. FIG. 4 shows the radiating face 50 of an exemplary $TE_{6,0}$ rectangular waveguide having a plurality of slots 60A-60N defined therein. The waveguide height is less than one-half wavelength, and the broadwall width is several free space wavelengths wide (over 3 wavelengths for a $TE_{6,0}$ waveguide). FIGS. 5-7 are respective cross-sectional views taken along respective lines 5—5, 6—6 and 7—7 of FIG. 4, and illustrate the manner in which the metal removed from the plane of the radiating face 50 is bent downwardly by a punch operation to form tabs.

The waveguide broadwall face 50 is characterized by several lines or axes 52A, 52B, . . . 52N along which, in the absence of slots employing the present invention, the net transverse current is zero. A plurality of slots are formed along each axis, spaced apart by a distance of one half the waveguide wavelength. Thus, slots 60A are defined longitudinally along the axis 52A, slots 60B are defined along the axis 52B, and slots 60N are defined along the axis 52N. These slots are not offset alternatively from the axis of zero transverse current as in the waveguide of FIG. 1, but rather are aligned with the axis.

The tabs for exciting the slots 60 alternate, remaining attached either to the left side or right side of the slot openings 60 created by the punching process. For high rate production, ganged punches create all the tabbed slots at one time. To achieve the alternation of tab positions, adjacent elements of the punching machine would be designed to punch-and-fold right, then punch-and-fold left, sequentially. Thus, tabs 62, 66 and 70 are attached to the left side of the slot openings; and tabs 64, 68 and 72 are attached to the right side of the slot openings. In that way, though the slots are only one-half waveguide wavelength apart, all slots are caused to radiate in phase with each other to produce the desired broadside radiation beam. If the left-side-right-side alternation is eliminated, a beam is formed at approximately 45° off broadside.

Figure 8:
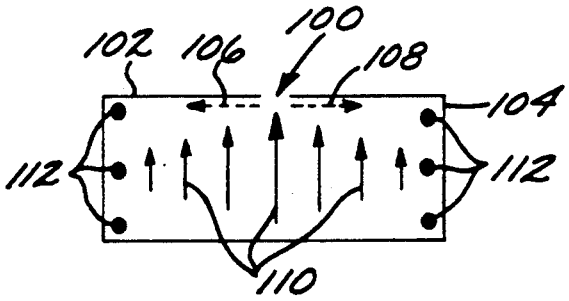
FIGS. 8-10 illustrate the electric field, magnetic field, and electric current in the transverse plane through the slots.

FIG. 8 shows the electric field, magnetic field, and electric current in the transverse plane through the middle of the length of an ordinary longitudinal slot 100 which is centered on the broadwall 102 of a $TE_{1,0}$ rectangular waveguide 104. The electric field lines are indicated by vertical arrows 110; the magnetic field lines are indicated by solid dots 112. The net current flowing transverse to the slot is zero since there is as much current flowing to the left (indicated by arrow 106) as to the right (indicated by arrow 108). Thus, there is no longitudinal magnetic field parallel to the longitudinal slot since the vector cross product of the zero net transverse current and the vector perpendicular to the broadwall is zero. Where there is no tab, a centered slot does not radiate because there is no longitudinal magnetic field there and there is zero net "displacement current" across the slot to excite the slot.

Figure 9:
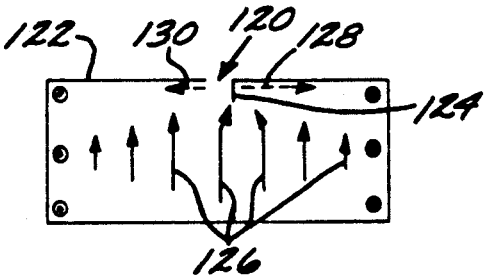

FIG. 9 shows a slot 120 formed in accordance with the invention in a waveguide broadwall 122. The slot 120 is still centered but there is a tab 124 on one edge of the slot. Now, the electric field (arrows 126) is perturbed and there is more current flowing to the right (arrow 128) than to the left (arrow 130). The non-zero net current at the centerline of the slot 120 causes the slot to be excited.

Figure 10:
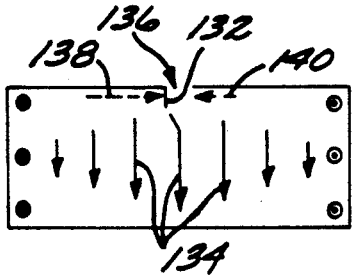

FIG. 10 represents a location one-half waveguide wavelength away from the plane of the slot FIG. 9 at the same instant of time. The 180° phase shift is seen in the fact that the electric field vector's direction (arrow 134) is reversed. The tab 132 is seen to be on the opposite edge of that slot 136 and this time there is more current flowing on the left side (arrow 138) of the slot than on the right side (arrow 140) and the net current at the center of the slot has the same direction as is occurring in FIG. 9. Thus, the radiation from both slots 130 and 136 has the same phase.

Figure 11:
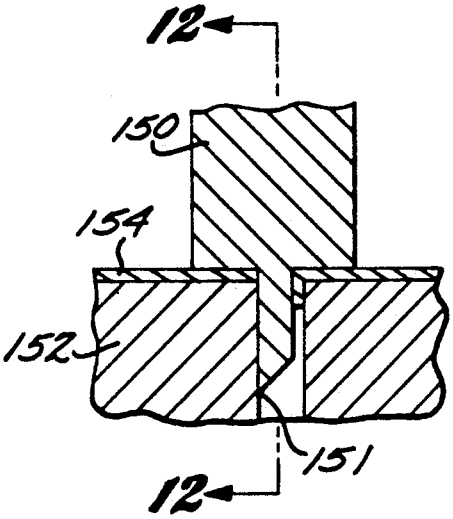
FIGS. 11 and 12 show a form of punching tool components.
Figure 12:
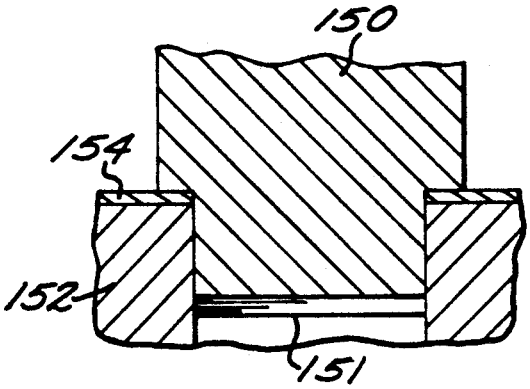

The thin metal broadwall punching may be achieved with a variety of designs for the male and female, i.e., the punch and die or punch and matrix, components of the punching tools. FIGS. 11 and 12 show one form of punching tool components which is illustrative of the many tool designs that can be employed to produce the same result. The punch 150 includes a sharp beveled edge 151 which penetrates the waveguide broadwall 154 by cooperation with the die 152. The punch 150 pushes the displaced metal downwardly against the side of the die 152. The punching operation is particularly efficient for a $TEN_{N,0}$ waveguide where N is greater than 1, e.g., 6 or greater. It is most cost effective to punch all the slots in the broadwall simultaneously and then join the slotted broadwall to the sidewalls to complete the waveguide. With a preformed $TE_{1,0}$ waveguide, only one set of slots along one axis can be punched before moving the die to the next waveguide.

"Probe excitation" has long been used to cause excitation of centered broad wall slots. Probe excitation is extremely narrow band in its operation, however, and the probes would add costs in that they would be additional parts to be fabricated and installed. The slender probe, on one side or the other of a slot, perturbs the fields in the waveguide so that a centerline slot is no longer at a plane of mirror symmetry of the fields in the waveguide. The slot then couples to the waveguide energy. The probe, however, is a post having a large value of inductance, and it does not completely cross the narrow dimension of the waveguide. The gap between the tip of the probe and the far broadwall forms a large capacitor which is in series with the inductive post. The probe excited slot exhibits very narrow band operation because of the high Q of that series resonant circuit. A large amount of probe penetration is required to obtain a significant amount of slot coupling. The tab coupler of this invention, on the other hand, requires only a small amount of penetration into the waveguide and, thus, is simply a non-resonant capacitive obstacle of small magnitude. That small capacitance is cancelled by adjusting the long dimension of the slot. It is well known that a slot that is shorter than its self resonant length has an inductive component to its impedance. The result is that the tab coupled slot has a bandwidth of operation several times wider than obtained with the probe coupled slots, because of the small value of the tab's capacitance.

It is understood that the above-described embodiment is merely illustrative of the possible specific embodiments which may represent principles of the present invention. Other arrangements may readily be devised in accordance with these principles by those skilled in the art without departing from the scope and spirit of the invention. For example, the slots could be inclined with respect to the axis, instead of being aligned with the axis as shown in FIG. 3. This would permit the phase changes for different slots, while at the same time obtaining the benefits of tab coupling. Thus, in this alternative arrangement, the slots are disposed at the same axis, but inclined with respect to the axis.

What is claimed is:

1. A rectangular waveguide-fed slot antenna employing tab coupled slots, comprising:

a waveguide having a broadwall, said broadwall having an axis relative to which a plurality of slots are placed, said broadwall serving to partially define a rectangular waveguide;

said plurality of slots defined in said broadwall arranged relative to said axis, wherein said slots are spaced by a distance of one-half the waveguide wavelength, said slots being formed by displacing waveguide broadwall material so that material displaced from the broadwall is bent into said waveguide to define a tab attached to said broadwall at only one side of each slot of said plurality of slots, said tabs causing excitation of said slots; and wherein said tab attaching side alternates from one adjacent slot to the next, said tabs extending substantially parallel to said axis, wherein all slots radiate in phase with each other to produce a desired broadside beam.

2. The antenna of claim 1 wherein said broadwall is fabricated of a metal, said slots being defined by punching metal material defining said broadwall into said waveguide, said punching separating said metal material from said broadwall except along said one side of said slot.

3. The antenna of claim 1 wherein said tabs are bent into said waveguide at substantially right angles to said broadwall.

4. The antenna of claim 1 wherein said slots are aligned with said axis.

5. A rectangular waveguide-fed slot antenna employing tab coupled slots, comprising:

a waveguide having a wide broadwall, said broadwall having several axes, said broadwall serving to partially define a rectangular waveguide;

a plurality of slots defined in said broadwall arranged relative to said axes, said slots being formed by displacing waveguide broadwall material so that material displaced from the broadwall is bent into said waveguide to define a tab attached to said broadwall at only one side of each slot of said plurality of slots, wherein said tab attaching side alternates from one adjacent slot to the next, said tabs extending substantially parallel to said axes, wherein all slots radiate in phase with each other to produce a desired broadside beam, said tabs causing excitation of said slot; and wherein said broadwall is fabricated of a metal, said slots being defined by punching metal material defining said broadwall into said waveguide, said punching separating said metal material from said broadwall except along said one side of each slot of said plurality of slots.

6. The antenna of claim 5 wherein said tabs are bent into said waveguide at substantially right angles to said broadwall.

7. The antenna of claim 5 wherein said slots re spaced by a distance of one-half the waveguide wavelength.

8. The antenna of claim 5 wherein said slots are aligned with respective ones of said axes.

9. A method of fabricating a shunt coupled array of slots in a metal broadwall of a waveguide, comprising a sequence of the following steps:

punching an array of slots arranged relative to a line in said broadwall by separating the metal to be displaced to define each slot from said broadwall, wherein said slots are spaced by a distance of one-half the waveguide wavelength, displaced material remaining attached a single side of said slot, said displaced metal defining a tab attached to said broadwall along said side, wherein said tab attaching side alternates from one adjacent slot to the next, said tabs extending substantially parallel to said line, wherein all slots radiate in phase with each other to produce a desired broadside beam; and bending said tab into said waveguide, said tab remaining attached to said slot side.

10. The method of claim 9 wherein said tabs are bent into said waveguide at substantially right angles to said broadwall.

11. The antenna of claim 9 wherein said slots are aligned with said line.

12. A method of fabricating a shunt coupled array of slots in a metal broadwall of a waveguide, comprising a sequence of the following steps:

punching an array of slots arranged relative to respective lines in said broadwall at a spacing of one-half the waveguide wavelength by separating the metal to be displaced to define each slot from said broadwall, displaced material remaining attached to a single side of said slot, said displaced metal defining a tab attached to said broadwall along said side, wherein said tab attaching side alternates from one adjacent slot to the next, said tabs extending substantially parallel to said lines, wherein all slots radiate in phase with each other to produce a desired broadside beam; and bending said tab into said waveguide, said tab remaining attached to said slot side.

13. The method of claim 12 wherein said tabs are bent into said waveguide at substantially right angles to said broadwall.

14. The method of claim 12 wherein said slots are spaced by a distance of one-half the waveguide wavelength.

15. The antenna of claim 12 wherein said slots are aligned with respective ones of said lines.

16. A rectangular waveguide-fed slot antenna employing tab couple slots, comprising:

a waveguide having an elongated broadwall, said broadwall having an axis with respect to which a plurality of slots are placed, said broadwall serving to partially define a rectangular waveguide;

said plurality of slots defined in said broadwall in relation to said axis, said slots being spaced by a distance of one half the waveguide wavelength, said slots being formed by displacing waveguide broadwall material so that material displaced from the broadwall is bent into said waveguide to define a tab attached to said broadwall at only one side of each slot of said plurality of slots, and wherein said tab attaching side alternates from one adjacent slot to the next, said tabs extending substantially parallel to said center axis, said tabs causing excitation of said slots, wherein all slots radiate in phase with each other to produce a desired broadside beam.

17. A rectangular waveguide-fed slot antenna employing tab coupled slots, comprising:

a waveguide having a wide broadwall, said broadwall having several axes relative to which along which slots are to be placed, said broadwall serving to partially define a rectangular waveguide;

a plurality of slots defined in said broadwall in relation to said axes, said slots being spaced by a distance of one haft the waveguide wavelength, said slots being formed by displacing waveguide broadwall material so that material displaced from the broadwall is bent into said waveguide to define a tab attached to said broadwall at only one side of each slot of said plurality of slots, and wherein said tab attaching side alternates from once adjacent slot to the next, said tabs extending substantially parallel to said axes said tabs causing excitation of said slots, wherein all slots radiate in phase with each other to produce a desired broadside beam.

18. A method of fabricating a shunt coupled array of slots in a metal broadwall, of a waveguide comprising a sequence of the following steps:

punching an array of slots relative to a line in said broadwall at a spacing of one-half the waveguide wavelength by separating the metal to be displaced to define each slot from said broadwall, displaced material remaining attached to a single side of said slot, said displaced metal defining a tab attached to said broadwall along said side;

bending said tab into said waveguide, said tab remaining attached to said slot side;

and wherein said side to which said tab is attached alternates from one slot side to the next for adjacent slots.

19. A method of fabricating a shunt coupled array of slots in a metal broadwall of a waveguide, comprising a sequence of the following steps:

punching an array of slots in relation to respective lines in said broadwall at a spacing of one-half the waveguide wavelength by separating the metal to be displaced to define each slot from said broadwall, displaced material remaining attached to a single side of said slot, said displaced metal defining a tab attached to said broadwall along said side;

bending said tab into said waveguide, said tab remaining attached to said slot side;

and wherein said side to which said tab is attached alternates from one slot side to the next for adjacent slots.

* * * * *